United States Patent [19]

Bleasdale

[11] Patent Number: 4,564,146

[45] Date of Patent: Jan. 14, 1986

[54] PAPER SHREDDING MACHINE

[75] Inventor: Stephen F. Bleasdale, Holmfirth, England

[73] Assignee: Ofshred Limited, Huddersfield, England

[21] Appl. No.: 510,603

[22] Filed: Jul. 5, 1983

[51] Int. Cl.[4] ..... B02C 18/22

[52] U.S. Cl. ..... 241/236; 83/DIG. 1; 241/37.5; 241/225

[58] Field of Search ..... 241/37.5, 225, 236, 241/224; 271/264, 272, 273, 274; 83/544, 545, 546, DIG. 1

[56] References Cited

U.S. PATENT DOCUMENTS

| | | | |
|---|---|---|---|
| 176,176 | 4/1876 | Guilder | 241/236 |
| 1,450,723 | 4/1923 | Gillespie | 241/225 X |
| 3,428,308 | 2/1969 | Bernard | 271/273 |
| 3,860,180 | 1/1975 | Goldhammer | 241/236 X |
| 4,269,403 | 5/1981 | Stephens et al. | 271/273 X |

FOREIGN PATENT DOCUMENTS

| | | | |
|---|---|---|---|
| 507777 | 4/1918 | France | 241/225 |
| 898976 | 6/1962 | United Kingdom . | |
| 982283 | 2/1965 | United Kingdom | 271/272 |
| 1229907 | 4/1971 | United Kingdom | 271/272 |
| 2024654 | 1/1980 | United Kingdom . | |

*Primary Examiner*—Howard N. Goldberg
*Assistant Examiner*—Joseph M. Gorski
*Attorney, Agent, or Firm*—Parmelee, Miller, Welsh & Kratz

[57] ABSTRACT

A paper-shredding machine has a sleeve mounted for limited movement towards and away from a surface of a housing of the machine to define an inlet opening, through which paper can be fed to cutters disposed within the housing. The sleeve normally occupies a position in which the inlet opening is closed but can move relative to the housing to admit paper through the inlet opening.

10 Claims, 1 Drawing Figure

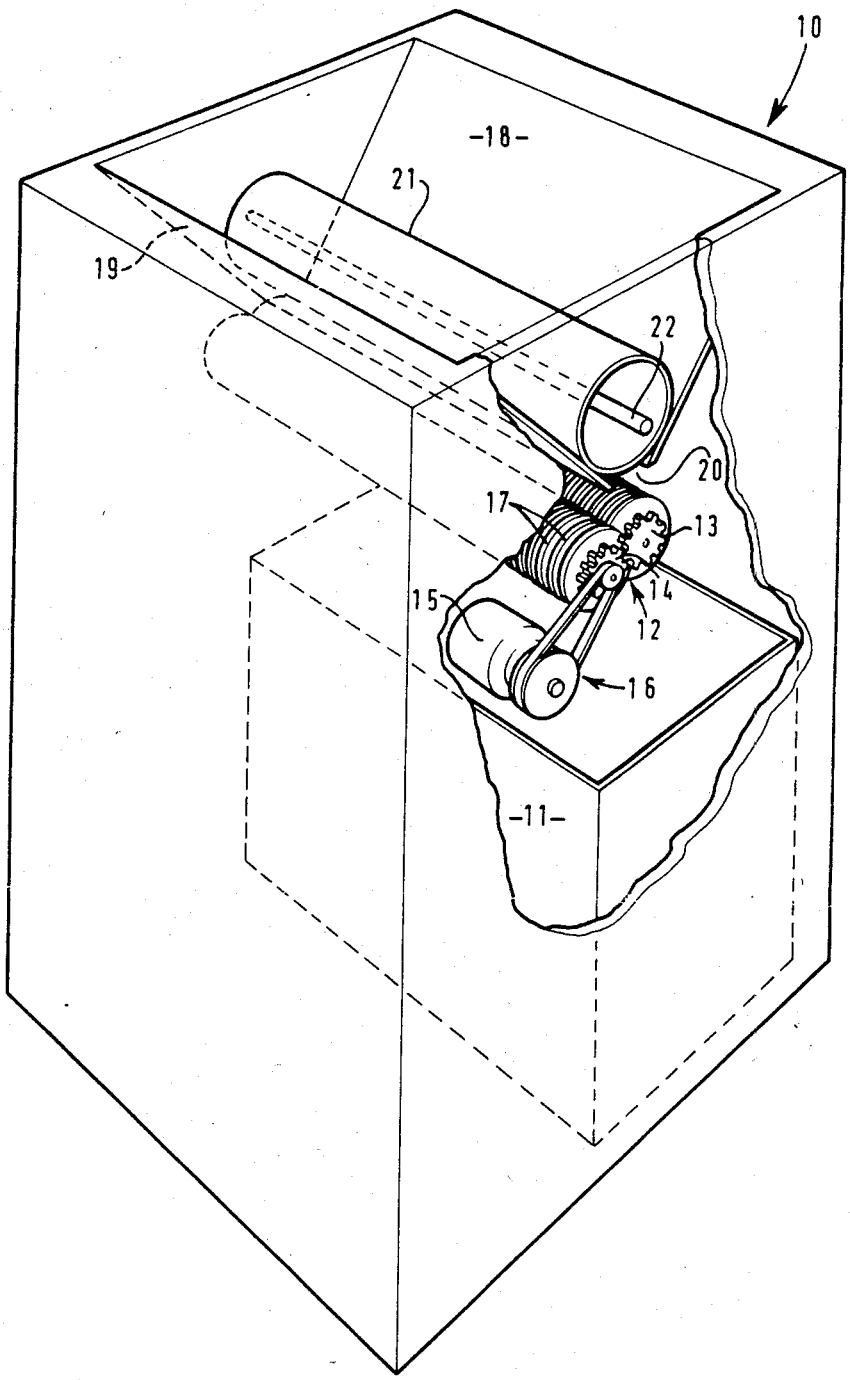
10
-18-
21
19
22
20
17
13
14
15
12
16
-11-

PAPER SHREDDING MACHINE

SUMMARY OF THE INVENTION

This invention relates to a paper shredding machine.

According to the invention, there is provided a paper shredding machine comprising a housing, a cutter assembly disposed within the housing, drive means for driving the cutter assembly and a closure member mounted for limited movement relative to the housing to define therewith an in-feed opening which is closed when the closure member is in a first position relative to the housing and through which, when the closure member is in a second position relative to the housing, paper sheets can be fed to the cutter assembly from outside the housing.

The provision of the movable closure member for the in-feed opening reduces the risk of the hair or clothing or other objects worn by a user reaching the cutter assembly through the in-feed opening inadvertently.

The closure member is preferably lightly biased towards its first position so that a paper sheet having typical stiffness can displace the closure member towards its second position when the paper sheet is advanced towards the cutter assembly into contact with the closure member. It will be appreciated that unusually flimsy sheets may not be capable, themselves, of displacing the closure member from its first position and would be required to be fed with somewhat stiffer sheets to the cutter assembly.

BRIEF DESCRIPTION OF THE DRAWING

An example of a paper shredding machine embodying the invention will now be described, with reference to the accompanying figure of the drawing drawing, which shows a perspective view of the shredding machine with a part of a housing thereof broken away to reveal internal parts.

DETAILED DESCRIPTION

The shredding machine illustrated in the drawing comprises a housing 10 having a door (not shown) in a front wall of the housing. At a position within the housing and adjacent to the door there is disposed a bin II for receiving shredded paper. When the door is open, the bin can be removed from the housing for emptying. Alternatively, there may be provided within the housing known means for compressing shredded paper into a bale which can be removed from the housing when the door is open.

At a level above the bin II, there is provided in the housing 10 a cutter assembly 12 of known form comprising a pair of shafts supported on the housing for rotation about mutually parallel horizontal axes and having meshing sprockets 13 and 14 which cause the shafts to rotate in opposite directions one with the other. For driving the shafts, there is provided on electric motor 15 connected by a belt and pulley drive 16 with one of the shafts. Each of the shafts carries a number of cutting discs spaced apart axially by spacers of smaller diameter so that a cutting disc on one shaft is opposite to a spacer on the other shaft. The axes of the shafts are spaced apart by a distance less than the diameter of the cutting discs so that the discs on one shaft partly overlap those on the other shaft.

An upper wall of the housing 10 presents two guide surfaces 18 and 19 spaced apart by a gap 20 which lies directly over the cutter assembly 12. The guide surfaces are mutually convergent towards the gap 20 and are each typically inclined at an angle of 45° to the horizontal. In the example illustrated, the guide surfaces are both flat and extend from the gap 20 to the outside of the housing.

The shredding machine further comprises a closure member 21 which, when the machine is not in use, normally rests on the guide surfaces 18 and 19 of the housing directly above the gap 20 and the cutter assembly 12. The closure member is a non-positively driven free-wheeling hollow tubular member of tubular form and, in the example illustrated, has a cylindrical external surface 32. Its length is approximately equal to the length of the gap 20 so that the gap is normally entirely obstructed by the closure member. The closure member is movable relative to the housing 10 in different ways. Thus, the closure member can rotate relative to the housing about its own longitudinal axis. The closure member can undergo displacement relative to the housing from the first position illustrated in the drawing, in which the closure member rests on the guide surfaces 18 and 19, to a second position in which the closure member is spaced from one of the guide surfaces to define therewith a rectilinear in-feed opening (not illustrated). The closure member can also undergo displacement relative to the housing 10 other than in a direction parallel to one of the guide surfaces 18 and 19 and can undergo a combination of rotation and displacement.

Displacement of the closure member 21 relative to the housing 10 is limited by a pin 22 connected to said hollow tubular closure member which extends through the interior of the closure member and has opposite end portions protruding from the closure member into engagement with the housing. These end portions are releasably secured in fixed positions relative to the housing but cannot be released without first removing parts of the housing. The diameter of the pin 22 is considerably less than the internal diameter of the closure member 21 and a radial clearance is provided between the pin means and the hollow tubular member. Alternatively a pair of relatively short pins may be provided, these extending a short distance into the closure member from opposite ends thereof to limit displacement of the closure member relative to the housing.

In the machine illustrated, the closure member 21 is biased by gravity into engagement with both of the surfaces 18 and 19. The closure member is formed of plastics material having a moderate density and has a thin wall so that the gravitational force exerted on the closure member is small, typically only a few grams. As an alternative arrangement, the closure member is rigidly mounted on a shaft which can rotate and can undergo displacement relative to the housing, the shaft being biased by resilient elements towards a first position in which the closure member engages the guide surfaces of the housing. In a further modification, which may be used with or without resilient biasing of the closure member, one of the guide surfaces 18 and 19 is eliminated, for example substituted by a horizontal surface which extends to a position directly above the closure member.

When a sheet is to be shredded by the machine, the sheet is moved down one of the guide surfaces, for example the guide surface 18, until a leading edge of the sheet reaches the position at which the closure member 21 rests on the guide surface 18. Continued movement of the sheet causes the closure member 21 to roll on the sheet so that the closure member is spaced from the guide surface 18 by the sheet. The sheet can continue to slide down the guide surface towards the cutter assembly 12 whilst the closure member rolls on the sheet. The inclination of the guide surface 18 is such that the leading edge of the sheet is directed into the nip between the cutting discs 17. The sheet moves along a path transverse to the length of the in-feed opening defined between the guide surface 18 and the closure. It will be noted that the closure member 21 does not significantly impede movement of the sheet towards the cutter assembly 12 and that the entire width of the infeed opening defined between the guide surface 18 and the closure member 21 is occupied by the sheet. When the trailing edge of the sheet passes beyond the closure member 21 towards the cutter assembly, the closure member is moved by gravity back to its first position, in which it contacts the guide surface 18 once more.

It will be noted that the guide surface 18 and the external surface of the closure member 21 (called herein the control surface) converge towards the in-feed opening so that the leading edge of a sheet is directed through the infeed opening towards the cutter assembly 12. In a case where the closure member is displaceable relative to the housing but is not rotatable, both of these mutually convergent surfaces may be flat. We prefer that the surface of the closure member which converges with the guide surface 18 be convex and be capable of rolling on sheets fed to the cutter assembly.

If the cutter assembly becomes jammed and is then driven in reverse, paper can emerge from the housing 10 through the gap 20 and easily push the closure member 21 away from one or both of the guide surfaces 18 and 19.

I claim:

1. A paper shredding machine for shredding paper sheets comprising: a housing having inclined guide surfaces spaced apart by a gap; a cutter assembly disposed within said housing and beneath said gap; drive means for driving said cutter assembly; a non-positively driven, free-wheeling hollow tubular closure member rotatable about its longitudinal axis, normally resting on said guide surfaces while covering said gap, and mounted for limited movement relative to said guide surfaces; and pin means not connected to said hollow tubular closure member and extending from the housing into said hollow tubular closure member with a radial clearance between said pin means and said hollow tubular closure member; wherein when said hollow tubular closure member is in a first position relative to said housing, said hollow tubular closure member rests upon said guide surfaces and closes said gap, and when said hollow tubular closure member is in a second position relative to said housing, a rectilinear infeed opening is formed between said hollow tubular closure member and at least one of said guide surfaces so that paper sheets can be fed to the cutter assembly along a path transverse to the length of said infeed opening with said hollow tubular closure member rolling on said paper sheets and displacement of said hollow tubular member being limited by said pin means.

2. A machine according to claim 1 wherein the closure member is biased by gravity towards its first position.

3. A machine according to claim 1 wherein the closure member is cylindrical.

4. A machine according to claim 1 wherein said closure member has a control surface which is cylindrical and defines an axis of the closure member and wherein said axis is movable relative to the housing during said movement of the closure member.

5. A machine according to claim 8 wherein the other of the guide surfaces is a flat guide surface, said guide surfaces are spaced apart from each other, are both downwardly inclined and are mutually convergent and wherein the closure member rests, when in said first position, on both said guide surfaces.

6. A machine as defined in claim 1 wherein the tubular member has a control surface, one of the guide surfaces and the control surface are mutually convergent towards the in-feed opening, and wherein the in-feed opening is closed when the closure member is in the first position.

7. A machine according to claim 6 wherein the guide surface of the housing is flat.

8. A machine as defined in claim 6 wherein one of the guide surfaces of the housing extends from the in-feed opening to the outside of the housing.

9. A machine as defined in claim 1 wherein said pin means comprises a pin extending through the interior of the tubular closure member and has end portions protruding from the closure member into engagement with the housing.

10. A machine as defined in claim 1 wherein said pin means comprises a pair of pins extending a short distance into the tubular closure member from opposite ends thereof.

* * * * *

UNITED STATES PATENT OFFICE

CERTIFICATE OF CORRECTION

PATENT NO. : 4,564,146

DATED : January 14, 1986

INVENTOR(S) : Stephen F. Bleasdale

It is certified that error appears in the above-identified patent and that said Letters Patent are hereby corrected as shown below:

On the cover page; between [22] and [51], insert the following:

-- [30] Foreign Application Priority Data

August 27, 1982 [GB] United Kingdom..... 24633 --.

Signed and Sealed this

First Day of April 1986

[SEAL]

Attest:

DONALD J. QUIGG

Attesting Officer

Commissioner of Patents and Trademarks